US005148745A

United States Patent [19]

Hamu

[11] Patent Number: 5,148,745

[45] Date of Patent: Sep. 22, 1992

[54] SCREEN PRINTING APPARATUS ASSEMBLY

[76] Inventor: Kaino J. Hamu, 16061 Dominica Cir., Huntington Beach, Calif. 92649

[21] Appl. No.: 666,374

[22] Filed: Mar. 8, 1991

[51] Int. Cl.[5] ..... B41F 15/14

[52] U.S. Cl. ..... 101/127.1; 101/114

[58] Field of Search ..... 101/121, 123, 124, 126, 101/127, 127.1, 128.4, 114

[56] References Cited

U.S. PATENT DOCUMENTS

| | | | |
|---|---|---|---|
| 2,129,163 | 9/1938 | Schneider | 101/124 |
| 2,164,603 | 7/1939 | Wheelwright | 101/126 |
| 2,895,412 | 7/1959 | Reed | 101/123 |
| 4,084,505 | 4/1978 | Schinose | 101/124 |
| 4,338.860 | 7/1982 | Hamu | 101/114 |
| 4,509,455 | 4/1985 | Shirataki | 101/123 |
| 4,669,378 | 6/1987 | Lee | 101/115 |
| 4,907,505 | 3/1990 | Ericsson et al. | 101/114 |
| 5,022,320 | 6/1991 | Szarka | 101/123 |

FOREIGN PATENT DOCUMENTS

| | | | |
|---|---|---|---|
| 1291701 | 3/1961 | France | 101/115 |

*Primary Examiner*—Edgar S. Burr
*Assistant Examiner*—Ren Yan
*Attorney, Agent, or Firm*—Boniard I. Brown

[57] ABSTRACT

A silk screen frame is removably attached directly to the screen frame carrier of a silk screen printing apparatus, such as the reciprocating screen frame support carriage of a silk screen press, by novel mounting brackets which are attached directly to the carrier and screen frame in such a way as to eliminate the need for the relatively heavy and costly master frame or the like which is commonly used to support the screen frame in conventional silk screen apparatus. The mounting brackets are uniquely constructed and adjustable relative to the screen frame and screen frame carrier to accommodate different screen frame types, including conventional frames, and a range of screen frame sizes and to permit precise alignment of the screen frame relative to the screen frame carrier.

15 Claims, 3 Drawing Sheets

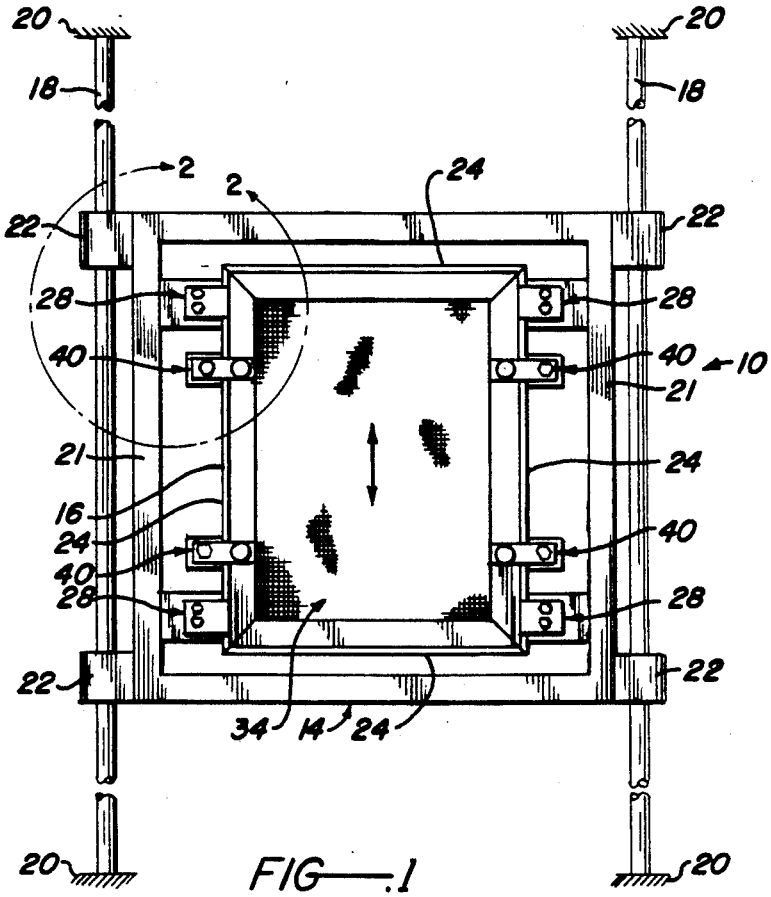
FIG—.1
PRIOR ART
FIG—.2
PRIOR ART
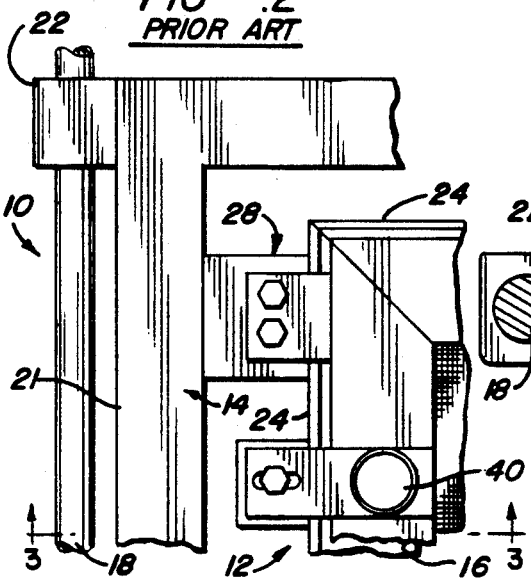
FIG—.3
PRIOR ART
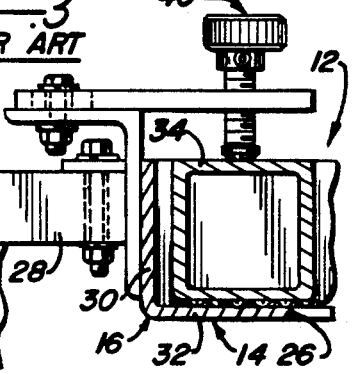

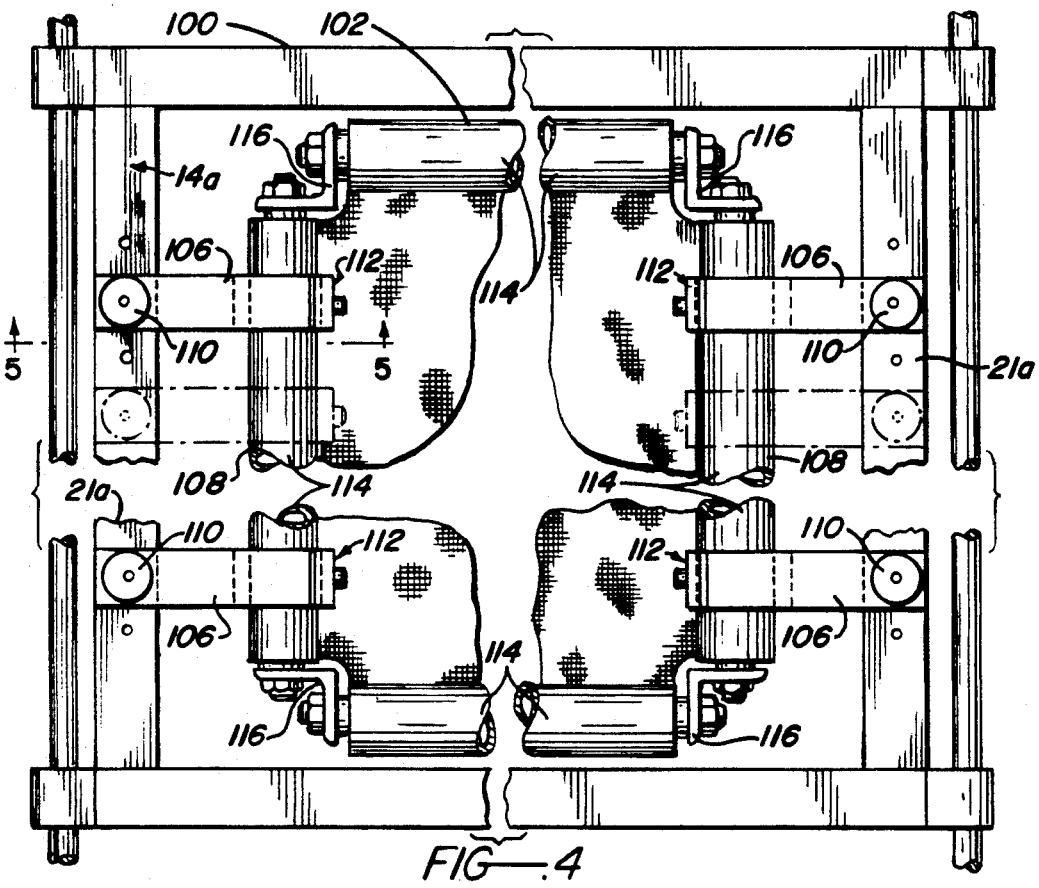
FIG—.4
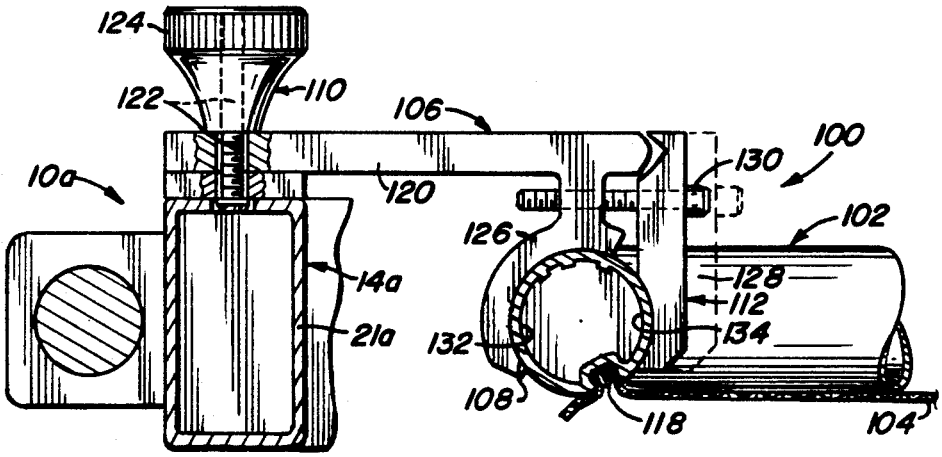
FIG—.5

FIG—.6
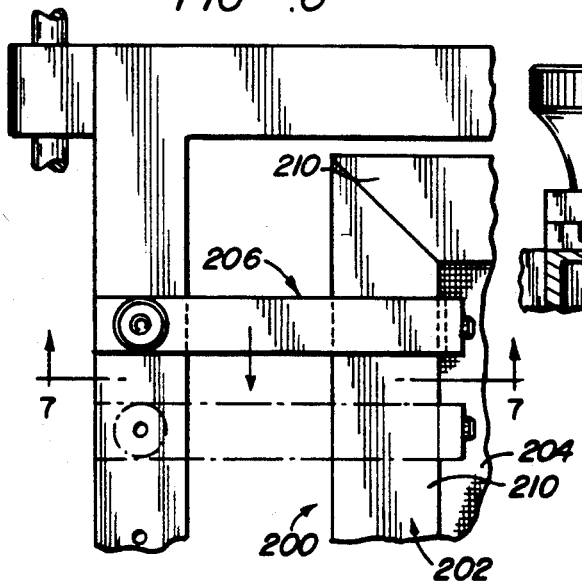
FIG—.7
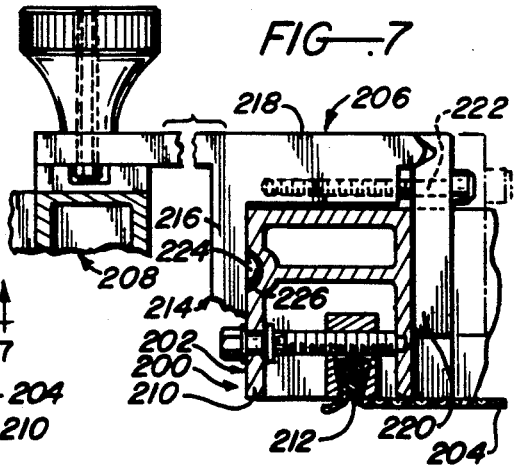
FIG—.8
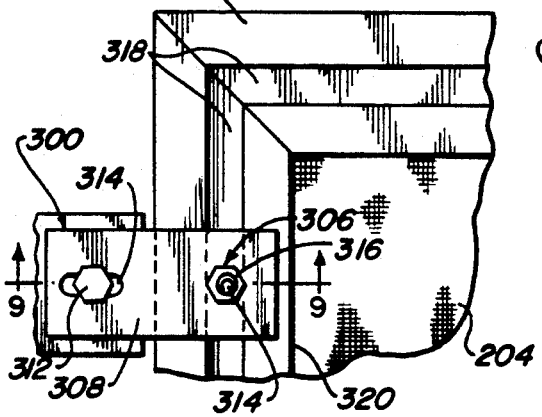
FIG—.9
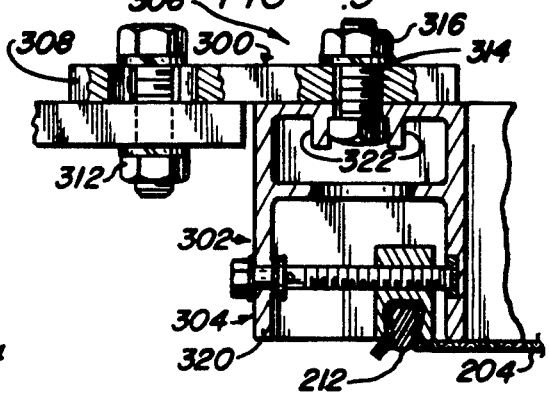
FIG—.10
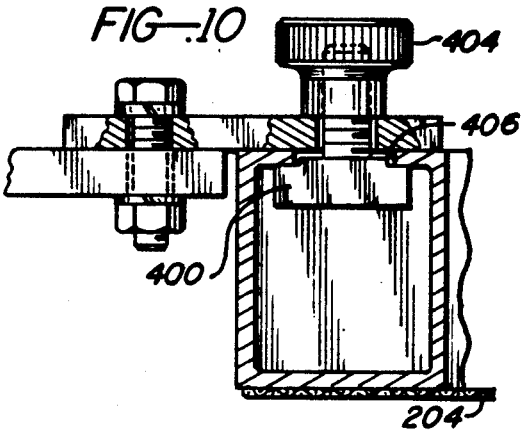
FIG—.11
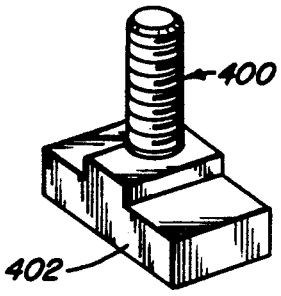

SCREEN PRINTING APPARATUS ASSEMBLY

BACKGROUND OF THE INVENTION

1. Field of the Invention

This invention relates generally to screen printing apparatus of the kind used to perform the printing process commonly referred to as silk screen printing. The invention relates more particularly to an improved mounting arrangement for mounting a silk screen frame on silk screen printing apparatus.

2. Prior Art

The printing process commonly known as silk screen printing is very well understood and extensively used for a great variety of printing applications. Accordingly, it is unneccessary to explain the process in any great detail in this disclosure. Suffice it to say that silk screen printing involves the use of a printing screen which has been processed to block selected holes in the screen in such a way that the open and closed screen holes form a pattern corresponding to the image to be printed. This screen is stretched edgewise across the normally lower side of a silk screen chase or stretch frame (referred to herein simply as a screen frame) to which at least two opposite edges of the screen are firmly secured to maintain the screen in a taut condition. During a printing operation, the lower side of the screen is placed in contact with a work surface to be printed, and a screen printing ink is spread across the upper side of the screen and forced through the open screen holes onto the work surface to form on the surface an image corresponding to the screen hole pattern.

The prior art is replete with a vast assortment of silk screen printing apparatus ranging from the very simple, such as a single manually positioned screen frame, to the relatively complex, such as automatic printing screen presses and multi-station screen printing machines. While they vary in complexity and overall design, most existing screen printing apparatus embody a screen frame carrier of some kind in which the screen frame is removably supported in such a way that the frame be quickly and easily removed and replaced. In a conventional silk screen press, for example, the screen frame is supported on a screen frame carrier which is rapidly driven back and forth to alternately ink the printing screen attached to the screen frame and then print a work surface. The present invention is particularly useful on such silk screen presses and for this reason will be described in the context of this use. It will become readily evident as the description proceeds, however, that the invention may be utilized on other types of screen printing apparatus.

The screen frame carrier of a conventional silk screen press comprises a carriage movably supported on the base of the press and a relatively heavy open rectangular master frame permanently mounted on the carriage. The screen frame is removably mounted in this master frame. Permanently secured to the master frame along its sides are means for releasably but firmly holding the screen frame in the master frame. In some silk screen presses, for example, the screen frame is releasably held in the master frame by clamps permanently mounted on the master frame.

This conventional screen frame mounting arrangement has certain disadvantages. Among the foremost of these disadvantages are the weight and high cost of the master frame and its integral screen frame clamps, and the inability of the mounting arrangement to accommodate certain types of screen frames, such as one having four rectangularly disposed screen anchor rollers joined end to end at the frame corners by corner brackets. The weight of the master frame is undesirable since it opposes rapid back and forth movement of the silk screen press carriage and thereby adversely affects the maximum press operating speed. The master frame weight also tends to increase the stress on and wear of the press parts and thereby increases the servicing periods, procedures, and costs neccessary to maintain the press in proper operating condition. The cost of the master frame, of course, adds to the overall cost of the press. Obviously, the foregoing factors are disadvantageous to some degree in all other types of silk screen printing devices which utilize screen frame mounting arrangements of the kind described. Accordingly, there is a need for an improved screen frame mounting arrangement for screen printing apparatus of the character described.

SUMMARY OF THE INVENTION

This invention provides such an improved screen frame mounting arrangement for silk screen presses and other screen printing apparatus of the character described. Simply stated, the improved mounting arrangement comprises a screen frame carrier on the basic si)k screen apparatus, a screen frame, and mounting brackets releasably securing the screen frame directly to the carrier in a manner which eliminates the need for the master frame of conventional silk screen apparatus. According to an important feature of the invention, the mounting brackets are uniquely constructed and adjustable relative to both the screen frame and screen frame carrier to accommodate screen frames of different sizes and types and permit precise alignment of a screen frame relative to the screen frame carrier.

The preferred screen frame mounting brackets of the invention have arms extending outwardly from the frame, generally edgewise of the frame, screen frame attachment means at the inner ends of the arms for securing the arms to the adjacent sides of the screen frame, and carrier attachment means at the outer ends of the arms for releasably securing the brackets to the screen frame carrier. Two preferred mounting bracket configurations are disclosed. The inner screen frame attachment means of one bracket configuration comprises a clamp for releasably gripping the adjacent side member of the screen frame. This bracket configuration can be utilized with various types of screen frame structures including those which have a rigid rectangular frame which mounts the screen gripping means and those whose frame structure is formed by four screen anchor rollers joined end to end at the frame corners by corner brackets. The inner screen frame attachment means of the other mounting bracket configuration comprises a bolt extending through the bracket arm and a longitudinal slot in the screen frame. Both types of screen frame attachment means permit adjustment of the mounting brackets along their adjacent screen frame sides. The outer carrier attachment means of both bracket configurations are adjustable relative to the screen frame carrier lengthwise of the adjacent screen frame sides. This adjustability of the mounting brackets relative to both the screen frame and screen frame carrier accommodates the invention to utilization with a variety of screen frames types and sizes and permits precise alignment of the mounted screen frame relative to the screen frame carrier.

As mentioned earlier, the screen frame mounting arrangement of the invention is particularly adapted to and will be described in connection with a silk screen press of the kind whose conventional screen frame carrier comprises a reciprocating carriage permanently mounting a master frame which removably supports the screen frame. According to the present invention, this heavy master frame is eliminated and the screen frame is attached directly to the press carriage by the screen frame mounting brackets. The master frame of most if not all silk screen presses is relatively heavy and quite costly so that its elimination reduces both the overall weight of the reciprocating parts of the press, i.e. screen frame and screen frame carrier, and the cost of the press. The weight reduction achieved by the invention results in substantially less stress on and wear of the parts of the press and thereby in a significant reduction in the frequency and cost of the maintenance procedures required to maintain the press in proper operating condition.

While the improvements of the invention are intended primarily for use on a silk screen press of the kind discussed above, it will become evident as the description proceeds that these improvements may be used on other types of silk screen apparatus. Accordingly, the invention should not be regarded as limited to screen printing presses.

BRIEF DESCRIPTION OF THE DRAWINGS

FIG. 1 is a fragmentary top plan view of a conventional silk screen press illustrating, in somewhat simplified and diagrammatic fashion, its screen frame carrier arrangement for mounting a silk screen frame on the press;

FIG. 2 is an enlargement of the area encircled by the arrow 2—2 in FIG. 1;

FIG. 3 is enlarged section taken on line 3—3 in FIG. 2;

FIG. 4 is a fragmentary top plan view of a silk screen press embodying an improved screen frame mounting arrangement according to the invention;

FIG. 5 is an enlarged section taken on line 5—5 in FIG. 4;

FIG. 6 is a fragmentary top plan view of a silk screen press embodying a modified screen frame mounting arrangement according to the invention;

FIG. 7 is an enlarged section taken on line 7—7 in FIG. 6;

FIG. 8 is a view similar to FIG. 6 illustrating another modified screen frame mounting arrangement according to the invention;

FIG. 9 is an enlarged section taken on line 9—9 in FIG. 8;

FIG. 10 is a section similar to FIG. 9 through yet another modified screen frame mounting arrangement according to the invention; and FIG. 11 is enlarged perspective view of a screen frame clamp bolt used in the mounting arrangement of FIG. 10.

DESCRIPTION OF THE PREFERRED EMBODIMENTS

Referring first to FIGS. 1-3 of these drawings, there is illustrated the screen frame carrier portion of a conventional silk screen press 10 which supports the silk screen to be printed and which the present invention improves. This press portion is shown in somewhat simplified and diagrammatic fashion so as to be representative of most, if not all, silk screen press arrangements. One example of such a press is that marketed by the Sakurai Company under the designation SC-102DX ULTRA HIGH SPEED CYLINDRICAL PRESS. With this in mind, a conventional press has a screen frame carrier 12 including a carriage 14 mounting a master frame 16. Carriage 14 comprises a rigid, generally open rectangular structure positioned between a pair of parallel rails 18 on the press base 20 with two opposite sides 21 of the carriage adjacent the rails, respectively. Along these two carriage sides are bearings 22 which slide on the rails and support the carriage for back and forth movement in the directions of the arrow in FIG. 1. The master frame 16 comprises four frame members 24 forming a rigid open rectangular frame structure. This master frame is positioned within the opening 26 through the carriage 14 and is permanently attached to the carriage sides 21 by attachment means 28. The master frame members 24 have upstanding side walls 30 and inwardly directed coplanar bottom flanges 32 along normally lower edges of the side walls.

Removably positioned within and supported on the bottom flanges 32 of the master frame 16 is a conventional printing screen frame assembly 34. This screen frame assembly comprises an open rectangular screen frame 36 proper and a printing screen 38, sometimes referred to as a silk screen, stretched across the underside of and secured about its edges to the screen frame. The screen frame assembly 34 is releasably secured in the master frame 16 by screw clamps 40 on the master frame.

During printing operation of the silk screen press 10, the screen frame carrier 12 and hence the printing screen frame assembly 34 are driven back and forth in the directions of the arrow in FIG. 1 by means not shown. During this back and forth movement, work pieces (not shown) to be printed are fed in succession to a printing position below the path of the screen frame assembly and are imprinted by alternately applying silk screen printing ink to the upper side of the printing screen 38 and then forcing the ink through the open holes of the screen while the underside of the screen is pressed against the work piece currently located in printing position.

This conventional silk screen press arrangement has the disadvantages mentioned earlier. These disadvantages reside in the relatively high cost and relatively heavy weight of the master frame 16. The cost of the master frame and its clamps adds to the overall cost of the silk screen press. The weight of the master frame produces the two fold adverse effect of (a) retarding rapid back and forth movement of the screen frame carrier 12 and thereby reducing the printing speed of the press, and (b) creating additional stresses on and wear of the parts of the press and thereby increasing the frequency and cost of the maintenance procedures neccessary to maintain the press in proper operating condition.

The silk screen press improvements of this invention, illustrated in FIGS. 4-11 of the drawings, overcome these disadvantages of the conventional screen frame mounting arrangement. Simply stated, the invention accomplishes this by replacing the master frame 16 and master frame clamps 40 of the conventional press by unique mounting brackets for removably mounting the screen frame assembly directly on the screen frame carrier of the press. In the case of the present invention, this screen frame carrier of the press is the reciprocating press carriage without the master frame and master frame clamps of the conventional press. The invention thus eliminates the cost and weight of the master frame and thereby reduces the overall cost of the silk screen press, the stresses produced by reciprocation of the press carriage, and the frequency and cost of the maintenance procedures neccessary to maintain the press in proper operating condition. The screen frame used in the invention may comprise any conventional or specially constructed screen frame. This screen frame and the mounting brackets of the invention constitute an improved frame assembly of this invention.

Referring to FIGS. 4 and 5, there is illustrated an improved screen frame assembly 100 according to this invention removably mounted on a silk screen press 10*a*. This press is identical to the conventional press 10 except for elimination of the master frame 16 and clamps 40 of the conventional press and certain minor differences, described below, between the carriage 14*a* of the press 10*a* and the conventional press carriage 14. Stated generally, the improved screen frame assembly 100 comprises an open rectangular screen frame 102, a printing screen 104 stretched edgewise across the normally bottom side of and secured about its edges to the screen frame, and screen frame mounting brackets 106 along two opposite sides 108 of the screen frame. These mounting brackets are releasably secured to the sides 21*a* of screen frame carrier or carriage 14*a* of the press to removably mount the screen frame assembly on the carriage. The carriage sides 21*a* thus constitute screen frame supporting portions of the carriage.

According to one important feature of the invention, the screen frame 102 may comprise any conventional or specially constructed screen frame. According to another important feature of the invention, the mounting brackets 106 are secured to the carriage sides 21*a* and to the adjacent screen frame sides 108 by releasable attachment means 110 and 112, respectively, which accommodate adjustment of the brackets along the carriage sides 21*a* and screen frame sides 108. This adjustment permits proper alignment of the screen frame assembly 100 relative to the press carriage 14*a* and accommodate mounting of screen frames 102 of different sizes and types in the press.

Referring now in more detail to the FIGS. 4 and 5, the particular screen frame 102 illustrated is a conventional screen frame of the kind illustrated in any number of patents including U.S. Pat. Nos. 3,601,912 and 3,908,293. This screen frame comprises four screen anchor rollers 114 which form the sides 108 of the frame and are joined at the corners of the frame by corner brackets 116. The rollers 114 have means 118 for gripping the edges of a printing screen 104 extending across the normally bottom side of the frame and are rotatable to stress the screen edgewise to a relatively taut condition suitable for silk screen printing procedures.

A pair of mounting brackets 106 are secured to each side 108 of the screen frame 102. Each mounting bracket has an arm 120 extending outwardly from the screen frame parallel to the plane of the frame and releasably secured at its outer and inner ends to the adjacent side 21*a* of the carriage 14*a* and to the adjacent frame side 108 by attachment means 110, 112, respectively. The outer carriage attachment means 110 comprises a releasable threaded fastener including an upstanding bolt 122 and a knurled nut 124 threaded on the bolt. The head end of the bolt is secured to the respective carriage side 21*a* in the manner illustrated. The threaded bolt shank extends upwardly above the carriage side and through a hole in the outer end of the respective bracket arm 120. The knurled nut 124 is threaded on the bolt shank above the bracket arm and is tightened to firmly clamp the arm to the carriage 14*a*. The inner screen frame attachment means 112 of the mounting bracket 106 comprises a clamp for gripping the adjacent screen frame side 108. This clamp includes a fixed clamp jaw 126 rigid on the inner end of the bracket arm 120, an opposing movable clamp jaw 128 fulcrumed at one end on the inner end of the bracket arm 120, and a clamp actuating screw 130 joining the jaws for urging free end of the movable jaw toward the fixed jaw. The clamp jaws 126, 128 of the several mounting brackets 106 straddle and are configured to firmly grip their adjacent screen frame sides 108 when their clamp screws 130 are tightened. In the particular inventive embodiment being described, the screen frame sides 108 are the screen frame rollers 114, and the clamp jaws 126, 128 have curved faces 132, 134, respectively, for engaging these rollers.

From the foregoing description, it will be understood that the screen frame assembly 100 is removably mounted, by its mounting brackets 106, directly on the press carriage 14*a*, without the aid of an intervening heavy master frame. The mounting brackets 106 are releasably secured to the carriage and are removable from the carriage with the screen frame assembly. The mounting brackets are also removable from the screen frame 102 so that they may be replaced if damaged and may be used on any number of such frames As mentioned earlier, a preferred feature of the invention, resides in the fact that the screen frame mounting brackets 106 are adjustable along the carriage sides 21*a* and the screen frame sides 108, i.e. screen frame rollers 114, to permit alignment of the screen frame 102 relative to the screen frame press 10*a* and to accommodate screen frames of different sizes and types. Obviously, the inner mounting bracket clamps 112 inherently permit such adjustment of the mounting brackets 106 along the the screen frame sides when their clamps 40 are loosened. To permit adjustment of the mounting brackets along the carriage sides 21*a*, a plurality of bracket attachment bolts 110 are mounted in spaced relation along each carriage side 21*a*. The position of each mounting bracket along its carriage side is accomplished by removing the bracket from one bolt and placing the bracket on a different bolt. Obviously, such mounting bracket adjustment relative to the press carriage 14*a* can be accomplished in other ways, as by making the outer bracket attachment bolts adjustable along the carriage sides 21*a*.

The modified inventive embodiment illustrated in FIGS. 6 and 7 is identical to that of FIGS. 4 and 5 except as noted below. The screen frame assembly 200 in FIGS. 6 and 7 includes a conventional screen frame 202, a printing screen 204 stretched edgewise across the normally bottom side of the screen frame, and mounting brackets 206 releasably securing the screen frame assembly to the screen frame carrier or carriage 208 of the silk screen press. The screen frame 202 comprises four channel-like frame members 210 of generally rectangular cross-section which are open along their bottom sides and are welded or otherwise rigidly joined to one another at their ends to form a rigid open rectangular frame structure. Within the frame members 210 are screen anchor means 212 which grip the edges of the screen 204 and secure the screen to the screen frame. Each screen frame mounting bracket 206 has an inner screen frame attachment means comprising a clamp 214 having a substantially flat fixed jaw 216 rigid on the mounting bracket arm 218, a substantially flat movable jaw 220 fulcrumed on the inner end of the bracket arm, and a clamp actuating bolt 222 for urging the movable jaw toward the fixed jaw to grip the adjacent screen frame member 210 between the jaws. The fixed jaw 216 has a longitudinal bead 224 engagable within a longitudinal groove 226 in the screen frame 202 to firmly hold the screen frame in place between the clamp jaws. Except for the different screen frame 202, screen anchor means 212, and flat mounting bracket clamp jaws 216, 220, the inventive embodiment illustrated in FIGS. 6 and 7 is identical to and used in the same way as that of FIGS. 4 and 5.

The inventive embodiment of FIGS. 8 and 9 is identical to that of FIGS. 6 and 7 except that the mounting brackets 300 of the screen frame assembly 302 in FIGS. 6 and 7 are releasably secured to the screen frame 304 by inner attachment means 306 which differ from the attachment means or clamps 214 in FIGS. 6 and 7. The inner attachment means 306 of each mounting bracket 300 comprises a bracket plate 308 adjustably secured by a bolt 312 to and forming an inner extension of the mounting bracket arm 310. Bolt 312 extends through a longitudinal slot 314 in the bracket plate, whereby the bracket plate is adjustable relative to the bracket arm 310. The opposite end of the bracket plate 308 is secured to the adjacent channel-like screen frame member 312 by a bolt 314 and nut 316. Bolt 314 extends through the bracket plate and a longitudinal slot 318 in the top wall of the adjacent screen frame member 320. In this case, the bolt head is located within the frame member and is restrained against turning by flanges 322 within the frame member. The nut 316 is located above the frame member for engagement by a wrench for tightening the bolt and nut to firmly secure the mounting bracket 300 to the screen frame 304. The mounting brackets 300 are adjustable along their screen frame members 320 by loosening their bolts and nuts. The inventive embodiment of FIGS. 8 and 9 is otherwise identical to and used in the same manner as that of FIGS. 6 and 7.

The inventive embodiment of FIGS. 10 and 11 is identical to that of FIGS. 8 and 9 except that the standard bolt 314 and nut 316 of each screen frame mounting bracket in FIGS. 8 and 9 are replaced, in FIGS. 10 and 11 by a bolt 400 with a stepped rectangular head 402 and a knurled handle nut 404. The bolt head 400 is restrained against turning by engagement of the stepped portion of the bolt head 402 in the corresponding screen frame slot 406.

I claim:

1. In a screen printing apparatus, the combination comprising:

a screen frame carrier including two spaced screen frame support portions, an open rectangular screen frame positioned between said support portions including frame members extending along two opposite sides of the frame adjacent said support portions, respectively, means mounting said screen frame on said carrier including a pair of totally separate mounting brackets extending between each support portion and the adjacent frame member at positions spaced along the adjacent frame member, carrier attachment means securing each bracket to its adjacent support portion, and frame attachment means securing each bracket to its adjacent frame member, and wherein said attachment means are adjustable along said support portions and frame members lengthwise of the frame members to permit individual adjustment of said bracket members along their adjacent support portions and frame members lengthwise of the frame members, and on attachment means of each mounting bracket is releasable to permit removal of said screen frame from said carrier.

2. A combination according to claim 1 wherein:

said frame has a normally bottom side and includes means for mounting a printing screen with the screen extending across said bottom side, and each frame member includes a normally lower side at said bottom side of the frame and normally inner and outer sides above said lower side facing edgewise of the frame, each mounting bracket includes an arm which extends outwardly from said frame generally edgewise of the frame and has an inner end located over the adjacent frame member and an outer end located over the adjacent support portion, said screen frame attachment means of each mounting bracket comprises a clamp at the inner end of the respective bracket arm including a pair of clamp jaws below the inner end of the respective bracket arm straddling the adjacent screen frame member edgewise of the frame above said bottom side of the frame, and clamp actuating means for relatively moving said jaws edgewise of the frame into and from gripping engagement with said inner and outer sides of the adjacent frame member, and said carrier attachment means of each mounting bracket are located at the outer end of the respective bracket arm.

3. A combination according to claim 2 wherein:

said screen frame members are cylindrical screen tensioning rollers, and said jaws have concave roller engaging surfaces.

4. A combination according to claim 2 wherein:

said frame members are generally rectangular in cross-section, said jaws have relatively flat frame member engaging surfaces.

5. A combination according to claim 1 wherein:

each mounting bracket includes an arm which extends outwardly from said screen frame generally edgewise of the frame and has an inner end located over the adjacent frame member and an outer end located over the adjacent support portion, said screen frame attachment means of each mounting bracket comprise a fastener extending through the inner end of the respective bracket arm and a longitudinal slot in the adjacent screen frame member, and said carrier attachment means of each mounting bracket are located at the outer end of the respective bracket arm.

6. A printing screen frame assembly to be mounted on a screen printing apparatus having a screen frame carrier including two spaced support portions for supporting said frame assembly, said screen frame assembly comprising:

an open rectangular screen frame having a screen side and including a pair of frame members located along two opposite edges of the frame, and means for securing a printing screen to said frame with the screen stretched edgewise across said screen side of the frame, and said frame being adapted to be positioned between said support portions with said frame members located adjacent said support portions, respectively, a pair of mounting brackets spaced along each said frame member each including screen frame attachment means securing the respective bracket to its adjacent frame member, and carrier attachment means for releasably securing the respective bracket to its adjacent support portion, whereby said brackets are adapted to mount said screen frame on said carrier, and wherein said attachment means are adjustable along said support portions and frame members to permit individual adjustment of each bracket along its respective support portion and frame member.

7. A printing screen frame assembly according to claim 6 wherein:

said frame has a normally bottom side which constitutes said screen side of the frame, each frame member includes a normally lower side at said bottom side of the frame and normally inner and outer sides above said lower side facing edgewise of the frame, each bracket includes an arm which extends outwardly from said frame generally edgewise of the frame and has an inner end located over its respective frame member and an opposite outer end, said screen frame attachment means of each mounting bracket comprise a pair of jaws below the inner end of the respective bracket arm straddling the respective screen frame member edgewise of the frame, and means for relatively moving said jaws toward and away from one another and into and from gripping engagement with said inner and outer sides of the respective frame member to releasably grip the respective frame member, and said carrier attachment means of each mounting bracket are located at the outer end of the respective bracket arm.

8. A printing screen frame assembly according to claim 7 wherein:

said frame members are cylindrical screen tensioning rollers, and said jaws have concave roller engaging surfaces.

9. A screen frame assembly according to claim 7 wherein:

said frame members are generally rectangular in cross-section, said jaws have relatively flat frame member engaging surfaces.

10. A screen frame assembly according to claim 6 wherein:

each mounting bracket includes an arm which extends outwardly from said screen frame generally edgewise of the frame and has an inner end located adjacent the respective frame member and an opposite outer end, said screen frame attachment means of each mounting bracket comprise a fastener extending through the inner end of the bracket arm and a longitudinal slot in the respective frame member, and said carrier attachment means of each mounting bracket are located at the outer end of the respective bracket arm.

11. For use on a screen printing apparatus including a screen frame carrier having two spaced screen frame support portions, and a printing screen frame positioned between said support portions having frame members along two opposite edges of the frame located adjacent said support portions, respectively, and means for securing a printing screen to said frame with the screen stretched edgewise across one side of the frame, a mounting bracket for attaching one frame member to the adjacent support portion, comprising:

an elongate bracket arm, screen frame attachment means at one end of said bracket arm for releasably securing said arm to one frame member of said screen frame, carrier attachment means at the other end of said arm for releasably securing said arm to one support portion and wherein said screen frame attachment means comprises a pair of clamp jaws at one side of and transverse to said bracket arm for straddling said one frame member, and means for effecting relative movement of said jaws toward and away from one another lengthwise of said bracket arm to releasably grip said one frame member between the jaws.

12. A mounting bracket according to claim 11 wherein: at least one jaw has a concave frame member engaging surface facing the other jaw.

13. In a screen printing apparatus, the combination comprising:

a screen frame carrier including two spaced screen frame support portions located substantially in a common normally generally horizontal plane and forming therebetween a space for receiving an open rectangular screen frame having frame members along two opposite edges of the frame adjacent said support portions, respectively, means for mounting said screen frame on said support portions with the frame positioned within said space including a pair of screen frame mounting brackets spaced along each support portion each having an inner end within said space and an outer end adjacent the respective screen frame support portion, carrier attachment means securing the outer end of each bracket to the adjacent support portion, and screen frame clamp means at the inner end of each bracket for gripping the adjacent screen frame member, and wherein said clamp means of each mounting bracket comprises a pair of clamp jaws which depend from the inner end of the respective bracket in a normally downward direction transverse to said plane, and clamp actuating means for effecting relative movement of said jaws generally parallel to said plane and transverse to said support portions between (a) an open position wherein the jaws are spaced in a direction generally parallel to said plane and transverse to said support portions to form between the jaws a normally downwardly opening space and the jaws are disposed to straddle the adjacent screen frame member edgewise of the screen frame, and (b) a closed position wherein the jaws are disposed to grip the adjacent screen frame member.

14. A combination according to claim 13 wherein:

said attachment means are adjustable along said support portions to permit individual adjustment of each bracket along its respective support portion.

15. In a screen printing apparatus, the combination comprising:

a screen frame carrier including two spaced screen frame support portions located in a common normally generally horizontal plane, an open rectangular screen frame positioned between said support portions having a normally bottom side and including frame members along two opposite edges of the frame situated adjacent said support portions, respectively, and each having a lower side at said bottom side of the frame and inner and outer sides facing edgewise of the frame, and means for stretching a printing screen across the bottom side of the frame, means mounting said screen frame on said support portions including a pair of screen frame mounting brackets spaced along each support portion each having an inner end adjacent the adjacent frame member and an outer end adjacent the respective screen frame support portion, carrier attachment means securing the outer end of each bracket to the adjacent support portion, and screen frame clamp means at the inner end of each bracket gripping the adjacent screen frame member, and wherein said clamp means of each mounting bracket comprises a pair of clamp jaws which depend from the inner end of the respective bracket in a normally downward direction transverse to said plane and straddle the adjacent frame member edgewise of and above said bottom side of the frame, and clamp actuating means for effecting relative movement of said jaws toward and away from one another into and from gripping engagement with said inner and outer sides of the adjacent frame member.

* * * * *